United States Patent [19]

Krein

[11] Patent Number: 4,671,733

[45] **Date of Patent: * Jun. 9, 1987**

[54] FREE STANDING, WATERPROOF LINING FOR TRUCK INDUSTRY

[76] Inventor: Reuben Krein, P.O. Box 2949, Fort Smith, Ark. 72913

[ * ] Notice: The portion of the term of this patent subsequent to May 14, 2002 has been disclaimed.

[21] Appl. No.: 733,962

[22] Filed: May 14, 1985

Related U.S. Application Data

[63] Continuation-in-part of Ser. No. 502,696, Jun. 9, 1983, Pat. No. 4,516,906.

[51] Int. Cl.[4] ..... B65D 88/12

[52] U.S. Cl. ..... 414/786; 53/175; 53/385; 105/355; 220/85 B; 220/462; 296/39 R; 414/373; 493/217

[58] Field of Search ..... 414/293, 373, 398, 786; 220/85 B, 410, 461, 462; 296/39 R, 39 A; 105/238 R, 357, 359; 493/217, 907; 53/175, 385, 570; 114/73, 75; 244/118.1; 410/68

[56] References Cited

U.S. PATENT DOCUMENTS

| | | | |
|---|---|---|---|
| 2,712,797 | 7/1955 | Woehrle et al. | 298/7 |
| 2,758,747 | 8/1956 | Stevens | 105/359 |
| 3,167,209 | 1/1965 | Jones | 220/461 |
| 3,468,102 | 9/1969 | Farrar et al. | 53/386 |
| 3,527,021 | 9/1970 | Pitts, Jr. et al. | 53/386 |
| 3,568,400 | 1/1969 | Pitts | 53/386 X |
| 3,798,870 | 3/1974 | Kanner et al. | 53/386 X |
| 3,988,970 | 11/1976 | Hanson et al. | 53/386 X |
| 4,461,402 | 7/1984 | Fell et al. | 220/85 B X |
| 4,516,906 | 5/1985 | Krein | 414/373 X |

FOREIGN PATENT DOCUMENTS

| | | | |
|---|---|---|---|
| 7501558 | 2/1975 | Netherlands | 220/85 B |

OTHER PUBLICATIONS

Container News, May 1983, "Dry Van Process Used to Ship Apples", by Bruce Johnson, pp. 68–70.

*Primary Examiner*—Robert J. Spar
*Assistant Examiner*—Staurt J. Millman
*Attorney, Agent, or Firm*—Jerry W. Mills; Gregory M. Howison

[57] ABSTRACT

A method of installing a continous moisture proof essentially disposable film liner within a convertional cargo trailer to protect moisture sensitive cargo during shipment. A polyolefin bag is inflated directly into an empty tractor trailer by attaching the bag opening to the outlet of a blower and blowing a gentle stream of air into the bag as suction is applied to the interior of the cargo trailer between the sidewalls of the trailer and the expanding polyolefin bag. In this manner, the bag inflates from the rear of the trailer forward, while the air trapped between the bag and the inside walls of the trailer is removed by suction, thus sealing the bag to the interior of the trailer. Once the bag is properly inflated and in contact with the inside of the trailer, it has been found that it tends to remain in place for sufficient time to load the cargo, even without continued use of the blower.

9 Claims, 7 Drawing Figures

FREE STANDING, WATERPROOF LINING FOR TRUCK INDUSTRY

CROSS-REFERENCE TO RELATED APPLICATION

This application is a continuation-in-part of a copending application Ser. No. 502,696, filed June 9, 1983, titled "Free Standing, Waterproof Lining for Truck Industry", now U.S. Pat. No. 4,516,906.

BACKGROUND OF THE INVENTION

1. Field of the Invention

This invention relates to a method of installing a free standing, waterproof lining in a truck trailer, cargo container or the like. More specifically, this invention relates to a vacuum or suction assisted method of inserting a disposable polyolefin bag or film liner into a semi-trailer during loading of the trailer such as to protect moisture sensitive cargo.

2. Description of the Prior Art

The basic concept of providing a semi-truck trailer with a liner and ancillary support equipment has been generally proposed in the past for various reasons. For example, in U.S. Pat. No. 2,712,797 a bag like flexible container is disclosed mounted in a dump truck trailer wherein supporting means for collapsing the flexible container is provided such that the trailer can be used for bulk haulage of pourable material as well as for general hauling. U.S. Pat. No. 3,756,469 discloses a flexible liner used in a hopper vehicle, again where the flexible liner is supported within the trailer such that it is collapsible, allowing the trailer to be converted to general hauling. Other specialized applications for open topped trailer liners have been proposed such as in U.S. Pat. No. 4,186,845 wherein a foamed base sheet with polymeric top sheet is proposed for creating a tub within a trailer and U.S. Pat. Nos. 3,980,196 and 4,124,136 disclose flexible liners with framework and bulk head that essentially convert the trailer into a container for bulk cargo transport. Similarly, U.S. Pat. No. 3,951,287 discloses a flexible liner that is support within a conventional semi-trailer by stretchable connectors along the trailer sidewalls that essentially convert the trailer to bulk material shipping.

In contrast to the prior art concept of using a flexible liner for bulk handling, theoretically there are other applications for use of a liner within a trailer provided such liner would be intrinsically extremely inexpensive, be readily and conveniently installed without essentially any down time or significant additional labor costs and provided that no other significant health hazard or risk is associated with its use. For example, it is known and generally tolerated in the trailer industry that certain types of common and ordinary goods statistically incur significant water damage associated with conventional transportation procedures independent of continuing efforts to prevent such shipping damage. In particular, moisture damage to cigarette and other tobacco products during transportation is known to be a troublesome problem in the industry, as is moisture and water damage to various paper products and paper related articles directly attributable to leaks in the semi-trailer. Although damages associated with such occurrences can be considered a significant statistical risk and cost from an insurance industry viewpoint, the actual effectiveness of correcting the problem by conventional methods (e.g., better packaging, sealing leaks in the trailer, etc.) is cost prohibitive relative to insuring the risk. In principle, an essentially disposable liner that could be selectively installed in a semi-trailer on an as needed basis would represent an ideal solution. To the best of the present inventor's knowledge, no one has proposed a method of installing an essentially stand alone, disposable polyolefin film bag that could be installed in a semi-trailer on short notice and enclose the entire cargo.

SUMMARY OF THE INVENTION

In view of the problems associated with shipping certain moisture sensitive cargo, I have discovered a method of installing a continuous film liner within an enclosed cargo trailer such as to serve as a moisture barrier protecting the cargo to be shipped within the trailer comprising the steps of:

(a) providing an enclosed cargo trailer having doors at one end wherein the trailer is intended to be used to ship moisture sensitive cargo;

(b) providing an air suction means adjacent to the interior walls of the enclosed cargo trailer;

(c) providing a deflated moisture proof film bag of dimensions slightly in excess of the interior dimensions of the trailer and having an opening in the film bag that corresponds to the doorway of the trailer;

(d) placing the deflated bag within the empty trailer such that the opening of the bag is located at the doorway of the trailer prior to placing cargo within the trailer;

(e) directing and blowing a stream of air into the bag opening while physically restraining the edge of the bag opening such that the air is directed towards the far end of the trailer;

(f) providing and maintaining suction to the air suction means while the blowing of air into the bag continues such as to direct the air to the far end of the trailer while simultaneously drawing the inflating bag into continuous contact with the interior of the trailer; and (g) temporarily attaching the bag opening of the inflated bag to the perimeter of the trailer doorway such as to allow cargo to be loaded within the trailer and inflated liner.

It is an object of the present invention to provide a method of installing an inexpensive thin film liner within a transportation or storage container such that the liner will protect cargo loaded into the container. It is a further object that this liner be a disposable polyolefin bag that remains essentially free standing during loading, wraps entirely around the cargo and seals during transportation or storage and is easily disposed of after use. Fulfillment of these objects and the presence and fulfillment of other objects will be apparent upon complete reading of the specification and claims taken in conjunction with the drawings.

DESCRIPTION OF THE PREFERRED EMBODIMENTS

Figure 1:
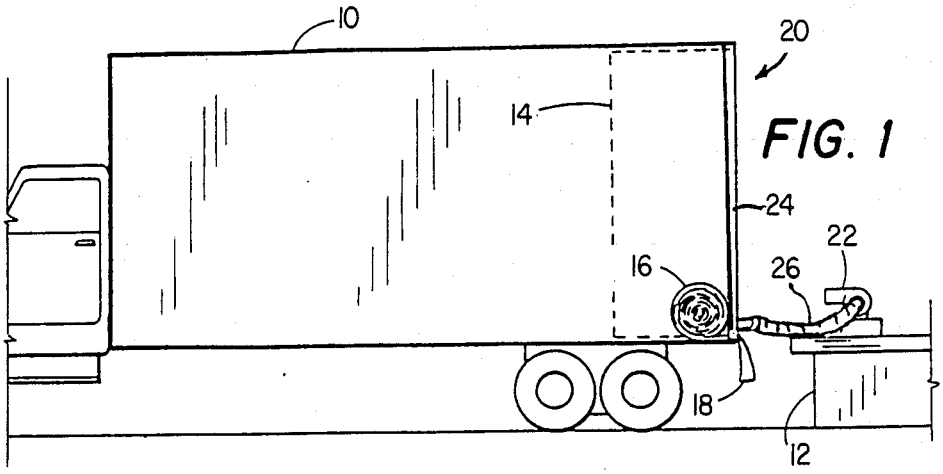
FIGS. 1 through 3 are partial cross-sectional views illustrating the sequential steps associated with the method of the present invention for placing a stand alone, moisture proof liner in a semi-trailer.

The method of installing a waterproof liner according to the present invention can perhaps be best explained and understood by reference to the drawings. FIG. 1 illustrates a conventional semi-tractor trailer 10 backed up to a loading dock 12 with rear doors 14 of the trailer 10 opened for installation of the liner 16. As illustrated, liner 16 is initially in a deflated state and, in this embodiment, rolled up in a tight coil. The liner 16 is essentially a large plastic bag or inflatable bladder wherein the opening 18 of the bag is positioned at the doorway 20 of the trailer. The bag is then unrolled or unfolded and stretched out such that it extends along the floor of the trailer with the closed end at the front of the trailer and the open end of the bag extending out the doorway. An air blower 22 is positioned on the dock 12 and directed toward the front of the trailer 10 such as to be turned on later when inflating the liner 16.

Figure 7:
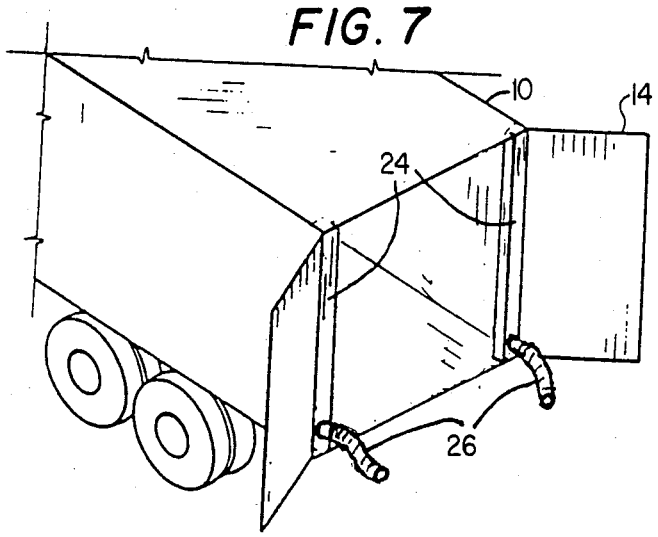
FIG. 7 illustrates the vacuum assist equipment or suction device according to the present invention installed in a semi-trailer before inflation of the liner.

Also, a pair of vertical vacuum tubes 24 (see FIG. 7) are inserted on the interior of the sidewalls at the rear of the semi-trailer near the hinged portion of the door 14. Each of the vacuum tubes 24 are connected via flexible hoses 26 to the suction side of blower 22. It should be appreciated that other physical configurations, equipment and methods of applying suction to the interior of the trailer or cargo container between the plastic bag and the container sidewalls can be employed in the present invention. As such, various suction tubes or other air channels can be readily incorporated into the present invention, including by way of example, but not limited thereto, horizontal tubes extending from the door of the trailer back into the rear of the container, air channels built into the sidewalls of the cargo container or trailer, horizontal suction tubes along the top and/or bottom of the doorway, and the like. It should be further appreciated that the vacuum tubes 24 of the drawing as well as any equivalent structure according to the present invention should be perforated (not shown) along the device such as to withdraw air potentially trapped between the expanding plastic bag and the sidewalls confining the bag.

Figure 2:
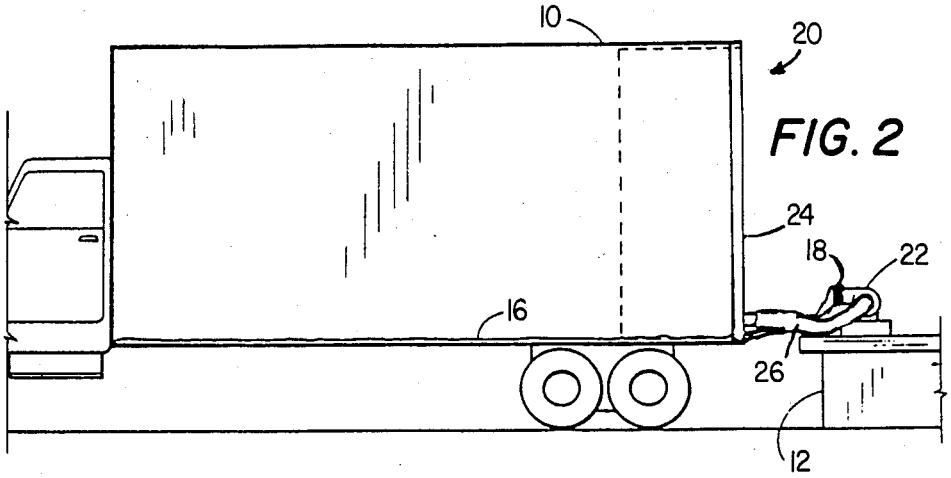

FIG. 2 illustrates liner 16 fully extended in the trailer 10 with the liner bag opening 18 being mounted directly to the air outlet side of the blower 22. Various alternative methods of attaching the bag 16 to the air supply can be employed. Thus, the opening 18 can be connected directly to the blower outlet as illustrated or can be attached to various types of nozzles, connectors or the like which in turn are fed air from a blower, air manifold or even compressed gas cylinder or other equivalent source. Similarly, it is envisioned that the vacuum tubes 24 can be physically attached through various types of nozzles, connectors or the like to any appropriate vacuum source, including the inlet side of the blower, air manifold connected to an inlet side of a blower or other equivalent low pressure device or equipment.

Figure 3:
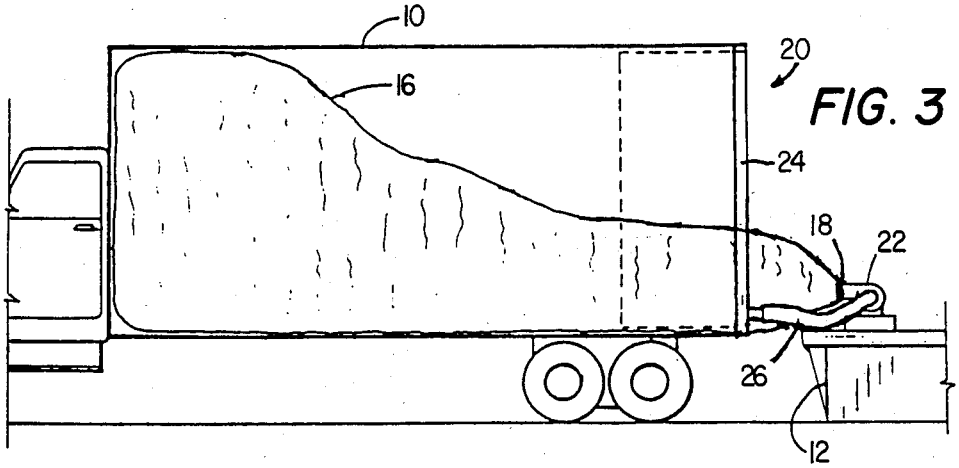

Having secured the opening 18 of the liner bag 16 to the blower 22, the blower is then turned on and a gentle stream of air is directed into the bag 16. The air is selectively directed to the front of the trailer 10 (see FIG. 3) such that the liner 16 inflates to the ceiling of the trailer in the front portion of the trailer first. The blower 22 continues to gradually fill the liner 16 from the front of the trailer to the rear of the trailer. To assist in this critical inflation step, tension can be selectively applied to the upper surface of the liner 16 by manually pulling downward and outward on the upper edge of the liner bag opening 18, if necessary. Experience indicates that if the liner bag is not inflated from the front to the rear, thus systematically displacing any trapped air behind the bag, the entire bag will tend to exit the trailer during the inflation step. Experience further indicates that applying sufficient suction to the region between the liner and confining sidewalls as it inflates, the tendency of the liner inside the trailer to be forced out of the trailer is significantly reduced.

In view of the above step, it is also critical that the dimensions of the liner bag be selected such that it will fit the entire interior of the trailer. Preferably, the liner bag is a cylindrically shaped bladder having a diameter slightly greater than the larger of the width or height of the inside of the trailer.

Figure 4:
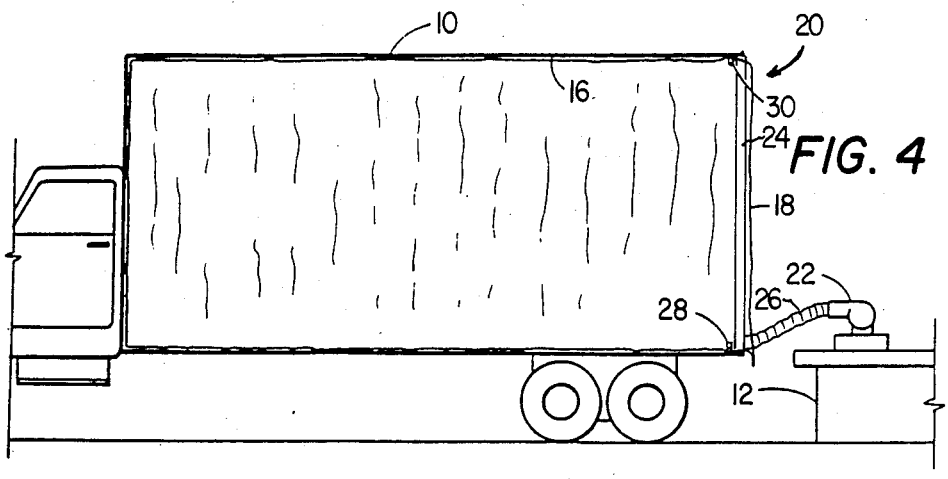
FIGS. 4 and 5 illustrate the free standing waterproof liner fully installed and ready for loading of the trailer.
Figure 5:
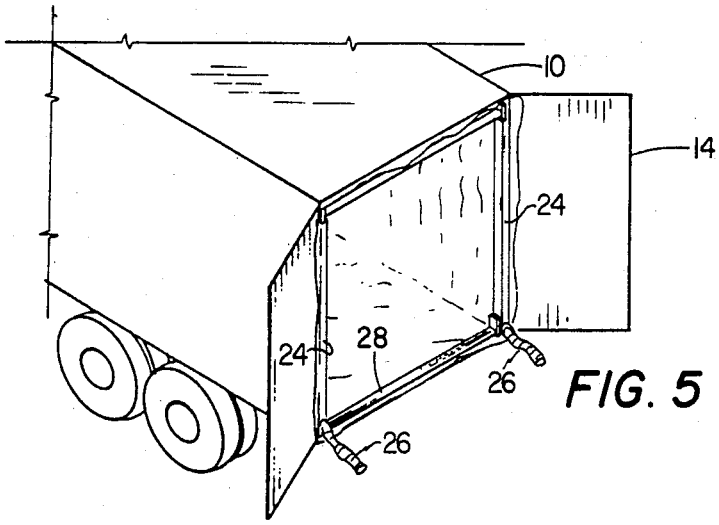
Figure 6:
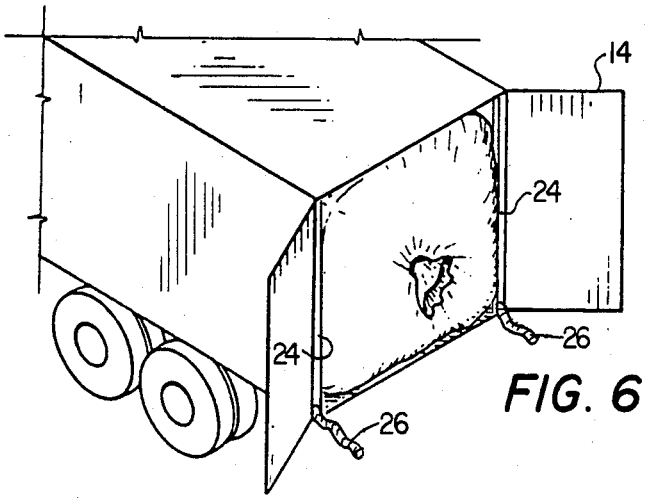
FIG. 6 illustrates the moisture proof liner sealed around the cargo of a loaded trailer.

As illustrated in FIGS. 4 and 5, once the bag liner 16 is fully inflated, the opening 18 can be removed from the air source and the liner 16 can be attached to the perimeter of the trailer doorway 20. In the specific embodiments of the drawing, the tension bars 28 and 30 are used to temporarily seal the bag opening 18 at the trailer doorway 20. Continued application of suction is an acceptable alternative to the use of tension bars. Also, any temporary sealing or fastening means or method well known in the art can be employed to temporarily attach the liner to the doorway. The trailer is now ready to be loaded in a conventional manner. During loading, the blower may also remain in operation. However, the liner once correctly inflated and sealed at the trailer doorway tends to remain in an inflated state for a considerable period of time, even without air or suction assist. After loading the cargo into the trailer, the blower is turned off and the excess liner material is wrapped around the end of the cargo and sealed such as to insure a moisture proof enclosure surrounding the entire cargo (see FIG. 6).

As previously stated, the bag liner or inflatable protective bladder of the present invention is preferably a thin polymeric film bag of sufficient size to make contact upon inflation with the entire interior of the enclosure. It is contemplated that the plastic bag can be made of any of the conventional film grade polymeric compositions, including by way of example, but not limited thereto, polyolefins such as high density polyethylene, low density polyethylene, polypropylene and blends thereof, film grade vinyl polymers as well as natural polymeric materials such as cellulose type films. The class of polymeric film compositions that has been found to be particularly useful in the manufacturing of the plastic liner are the film grade blends of high density polyethylene with low density polyethylene. The bag is contemplated as being capable of being fabricated from a series of polymeric strips or sheets which are adhesively bonded or heat sealed along longitudinal seams to each other to form the bag. The bag can also be extruded in a single sheet or cylindrical tube provided an extrusion dye of sufficient size is available. If longitudinal pieces are to be sealed together to make the bag, the use of a thicker film for the floor, along with color pigmentation and non-slip additives to identify the floor versus the sidewalls can be incorporated into the construction of the bag liner. Experience indicates that when polyolefins such as polyethylene blends are used, the bag can be made out of a relatively thin film. A 2 mil polyethylene film has been successfully tested under conventional interstate commerce transportation conditions and has proved to be quite adequate for purposes of this invention. In fact, such liners have exhibited the ability to be reused if desired, but the inexpensive nature of the thin film would not necessitate reuse and is highly suggestive of disposing of the bag after one shipment.

The actual time, effort and equipment employed to install the bag liner is surprisingly nominal. Under conventional semi-trailer dock loading procedures and environment, the time required to actually inflate the liner bag has been measured to be as short as 30 seconds. The procedure employed during this observation was essentially as illustrated in the drawing and involved air movement equivalent to that produced by a conventional air blower or air fan.

The use of polyolefin film bag liners of the present invention is particularly useful to protect tobacco products, paper products, foods and drugs, as well as other highly moisture sensitive cargo. The bag liners are also useful in shipping cargo that require ultra clean or an uncontaminated environment and could also be readily adapted to be used to maintain an inert vapor phase or gaseous environment. It is envisioned that the method of installing the film liner can be advantageously employed in semi-trailers, cargo containers or generally any equivalent transportation or storage facility wherein an inexpensive, throw-away plastic liner would be appropriate.

Having thus described and exemplified the preferred embodiments of the present invention with a certain degree of particularity, it is manifest that many changes can be made within the details of operation, operating parameters, and implementation of the steps without departing from the spirit and scope of this invention. Therefore, it is to be understood that the invention is not limited to the embodiments set forth herein for purposes of exemplification, but is to be limited only by the scope of the attached claims, including the full range of equivalents to which each step thereof is entitled.

I claim:

1. A method of installing a continuous film liner within an enclosed cargo trailer such as to serve as a moisture barrier protecting the cargo to be shipped within said trailer comprising the steps of:

(a) providing an enclosed elongated cargo trailer having a horizontal loading surface and doors at one end for loading of cargo therethrough wherein said trailer is intended to be used to ship moisture sensitive cargo;

(b) providing an air suction means adjacent to the interior walls of said enclosed cargo trailer;

(c) providing a deflated moisture proof film bag of dimensions slightly in excess of the interior dimensions of said trailer and having an opening in said film bag that corresponds to the doorway of said trailer;

(d) placing said deflated bag within said empty trailer such that the opening of said bag is located at the doorway of said trailer and said bag extends along the length thereof prior to placing cargo within said trailer;

(e) directing and blowing a stream of air into said bag opening while physically restraining the edge of said bag opening such that said air is directed towards the far end of said trailer to lift the interior sides of said bag outwards against the interior sides of said trailer;

(f) providing and maintaining suction to said air suction means while the blowing of air into the bag continues such as to direct the air to the far end of the trailer while simultaneously creating a negative pressure in the space between said bag and the interior sides of said trailer drawing the inflating bag into continuous contact with the interior of said trailer; and (g) temporarily attaching the bag opening of the inflated bag to the perimeter of the trailer doorway such as to allow cargo to be loaded within the trailer and inflated liner.

2. A method of installing a continuous film liner within an enclosed cargo trailer according to claim 1 further comprising the steps of:

(a) filling the trailer and bag with moisture sensitive cargo;

(b) detaching the film bag from the trailer doorway; and (c) sealing the film bag around the cargo such as to protect the cargo during shipment.

3. A method of installing a continuous film liner within an enclosed cargo trailer according to claim 1 wherein the film bag is a cylindrical disposable polyolefin bag of effective diameter slightly greater than the larger of the interior height or width of said cargo trailer.

4. A method of installing a continuous film liner within an enclosed cargo trailer according to claim 2 wherein the film bag is a cylindrical disposable polyolefin bag of effective diameter slightly greater than the larger of the interior height or width of said cargo trailer.

5. A method of installing a continuous film liner within an enclosed cargo container such as to serve as a moisture barrier protecting the cargo to be shipped within said container comprising the steps of:

(a) providing an enclosed elongated cargo container having a horizontal loading surface and doors at one end for loading of cargo therethrough wherein said container is intended to be used to ship moisture sensitive cargo;

(b) providing an air suction means adjacent to the interior walls of said enclosed cargo container proximate the peripheral edges of the doorway;

(c) providing a deflated moisture proof film bag of dimensions slightly in excess of the interior dimensions of said container and having an opening in said film bag that corresponds to the doorway of said container;

(d) placing said deflated bag within said empty container and along the horizontal loading surface such that the opening of said bag is located at the doorway of said container prior to placing cargo within said container;

(e) directing and blowing a stream of air into said bag opening along a horizontal path while physically restraining the edge of said bag opening such that said air is directed towards the far end of said container to lift the interior sides of said bag upwards and outwards toward the interior sides of said trailer;

(f) providing and maintaining suction to said air suction means while the blowing of air into the container continues such as to direct the air to the far end of the container while simultaneously drawing the inflating bag into continuous contact with the interior of the container; and (g) temporarily attaching the bag opening of the inflated bag to the perimeter of the container doorway such as to allow cargo to be loaded within the container and inflated liner.

6. A method of installing a continuous film liner within an enclosed cargo container according to claim 5 further comprising the steps of:

(a) filling the container and bag with moisture sensitive cargo;

(b) detaching the film bag from the container doorway; and (c) sealing the film bag around the cargo such as to protect the cargo during shipment.

7. A method of installing a continuous film liner within an enclosed cargo container according to claim 5 wherein the film bag is a cylindrical disposable polyolefin bag of effective diameter slightly greater than the larger of the interior height or width of said cargo container.

8. A method of installing a continuous film liner within an enclosed cargo container according to claim 6 wherein the film bag is a cylindrical disposable polyolefin bag of effective diameter slightly greater than the larger of the interior height or width of said cargo container.

9. A method of installing a continuous film liner within an enclosed cargo container according to claim 1 wherein the step of providing an air suction means comprises disposing suction creating means adjacent the peripheral edges of the doorway between the peripheral edges of said bag opening and the peripheral edges of the doorway.

* * * * *